US005783350A

United States Patent [19]

Matsuoka et al.

[11] Patent Number: 5,783,350

[45] Date of Patent: Jul. 21, 1998

[54] DEVELOPER FOR ELECTROSTATIC PHOTOGRAPHY AND IMAGE FORMING METHOD

[75] Inventors: Hirotaka Matsuoka; Takako Kobayashi, both of Minami-ashigara, Japan

[73] Assignee: Fuji Xerox Co., Ltd., Tokyo, Japan

[21] Appl. No.: 762,396

[22] Filed: Dec. 9, 1996

[30] Foreign Application Priority Data

Dec. 14, 1995 [JP] Japan ..... 7-325462

[51] Int. Cl.[6] ..... G03G 9/125

[52] U.S. Cl. ..... 430/116; 430/112; 430/115

[58] Field of Search ..... 430/112, 115, 430/116

[56] References Cited

U.S. PATENT DOCUMENTS

| | | | |
|---|---|---|---|
| 3,079,272 | 2/1963 | Greig | 430/116 |
| 3,247,007 | 4/1966 | Oliphant | 430/112 |
| 3,264,272 | 8/1966 | Rees . | |
| 4,794,651 | 12/1988 | Landa et al. | 430/110 |
| 5,229,235 | 7/1993 | Watanabe et al. | 430/116 |
| 5,622,804 | 4/1997 | Matsuoka et al. | 430/116 |

FOREIGN PATENT DOCUMENTS

| | | |
|---|---|---|
| B-40-19186 | 5/1959 | Japan . |
| B-45-14545 | 5/1970 | Japan . |
| B-2-56-9189 | 2/1981 | Japan . |
| A-58-2851 | 1/1983 | Japan . |
| A-58-129438 | 8/1983 | Japan . |
| A-58-152258 | 9/1983 | Japan . |
| A-59-87436 | 5/1984 | Japan . |
| A-2-6965 | 1/1990 | Japan . |
| A-2-6966 | 1/1990 | Japan . |
| A-2-6967 | 1/1990 | Japan . |
| A-2-304575 | 12/1990 | Japan . |
| A-3-196152 | 8/1991 | Japan . |
| A-3-196154 | 8/1991 | Japan . |
| A-3-196158 | 8/1991 | Japan . |
| A-5-72820 | 3/1993 | Japan . |
| A-5-197297 | 8/1993 | Japan . |
| 7-325433 | 12/1995 | Japan . |
| 7-325434 | 12/1995 | Japan . |

OTHER PUBLICATIONS

Journal of Scientific Instruments, vol. 32, Feb. 1955, "Laboratory and Workshop Notes", K.A. Metcalfe, pp. 74–75.

Journal of Scientific Instruments, vol. 33, May 1956, "Fine grain development in xerography", K.A. Metcalfe, et al., pp. 194–195.

*Primary Examiner*—Roland Martin

*Attorney, Agent, or Firm*—Oliff & Berridge, PLC

[57] ABSTRACT

The developer for electrostatic photography according to the present invention comprises toner particles containing a thermoplastic resin and a colorant dispersed in an electrically insulating carrier having a melting point above room temperature wherein the thermoplastic resin is insoluble in the electrically insulating carrier at a temperature below the melting point of the electrically insulating carrier but becomes solvated with the electrically insulating carrier at a temperature above the melting point of the electrically insulating carrier. The present invention provides a developer for electrostatic photography, which enables to reduce the emission of vapor, to carry out a fixing treatment at a higher rate, to reduce the amount of energy required for fixing treatment and to create a high-quality image even after repeated use of the developer.

12 Claims, 4 Drawing Sheets

DEVELOPER FOR ELECTROSTATIC PHOTOGRAPHY AND IMAGE FORMING METHOD

BACKGROUND OF THE INVENTION

1. Field of the Invention

The present invention relates to a developer for electrostatic photography utilizing a fusible carrier and to an image forming method using this developer.

2. Description of the Related Art

A wet development process in electrophotography generally consists of the steps of forming an electrostatic latent image on a photosensitive body by charging and subsequent exposure, developing the electrostatic latent image by use of a developer comprising toner particles consisting primarily of a resin and a colorant dispersed in a carrier (normally an aliphatic hydrocarbon), transferring the obtained toner image to a transfer paper and fixing the transferred toner image to form an image. Besides, this wet development process is sometimes utilized as a development method in an electrostatic recording process or the like wherein an electrostatic latent image is formed on a dielectric body by means of an electrical input without the use of a photosensitive body.

In such a wet development process, an electrostatic latent image is developed based mainly on an electrophoresis by use of a developer comprising toner particles of particles sizes in a liquid such as an aliphatic hydrocarbon having a high electric resistance. Because of this, a wet development process has an advantage that an image of a higher resolution is obtainable relative to a dry development process in which toner particles having particle sizes of not less than several micrometers are used.

However, a developer comprising a dispersion of finer toner particles is associated with a reduction in the speed of development process based on electrophoresis, because the charge per a toner particle is small and the following problems arise: (1) Image density is not intensified; and (2) The process is not suitable to a high speed copying operation.

According to a conventional wet development process, often a toner comprises a dispersion of a colorant consisting primarily of a pigment and a resinous ingredient soluble in a carrier. This toner is fixed to a printing paper based on a mechanism that the carrier evaporates and dries due to a heat applied to fix an image, thereby depositing and adhering the soluble resin onto the recording paper. However, the above-mentioned toner of a conventional wet development process has a drawback that its adhesion to a substrate is poor and the cohesive force of its image is so small that the mechanical strength of the image is weak.

In addition, almost all of substances proposed as a carrier in a conventional wet development process are an organic solvent having a high vapor pressure. As a result, in the case of a developer for a conventional wet development process, the carrier vapor which is discharged during image fixing operation and the carrier which remains in a substrate after the fixing treatment present the problem of odors peculiar to solvents.

Examples of a carrier in the case of a developer for a conventional wet development process are gasoline, kerosene and carbon tetrachloride as already described in two of early literature disclosed by K. A. Metcalfe, J. Sci. Instrum., 32, 74 (1955) and 33, 194 (1956). Besides, representative of the descriptions regarding carriers in toner manufacture patents are Japanese Patent Application Publication (JP-B) Nos.40-19186, 45-14545 and 56-9189, which disclose as a carrier (also used as a dispersion medium for polymerization) an aromatic hydrocarbon, such as toluene, xylene and benzene, and an aliphatic hydrocarbon such as n-hexane, isododecane and Isopar H, G, L and V available from Exxon Chemicals Corp.

In order to overcome the above-mentioned problem induced by the evaporation of a carrier, a technique is proposed which comprises utilizing as a carrier a hydrocarbon which is virtually solid at room temperature and to keep it in a fused state by an appropriate heating means at the time when an electrostatic latent image is developed. For example, as a wet process developer containing such a carrier, Japanese Patent Application Laid-Open (JP-A) Nos.2-6967, 2-6965 and 2-6966 propose a developer comprising a colorant dispersed in an electrically insulating substance which is solid at room temperature and which liquefies on heating and solidifies on cooling. In addition, Japanese Patent Application Laid-Open (JP-A) Nos.2-304575, 3-196152, 3-196154, 3-196158, 5-197297 and 5-72820 disclose a thermoplastic resin, a wax, a paraffin and the like as illustrative examples of electrically insulating substances which are solid at room temperature.

In the case of the above-mentioned wet process developers, which comprise a dispersion of a colorant consisting primarily of a pigment and a resinous ingredient soluble in a carrier, one of the encountered problems is that the toner particles are mostly as small as the colorant particles and have particle sizes in the range of 0.1 to 0.5 μm with the result that the development process speed-up is difficult by the aforementioned reason. Another problem is that repetition of heating or hysteresis of heating→cooling→heating in an image forming apparatus (1) decreases the stability of colloid to an extent that toner particles coagulate or viscosity of carrier increases during storage thereby leading to decrease in reliability of the developer with lapse of time; and (2) significantly decreases the charge of toner to an extent that a stable image output cannot be maintained for a long period of time.

On the other hand, Japanese Patent Application Laid-Open (JP-A) Nos. 58-2851, 58-152258 and 59-87436 and U.S. Pat. No. 4,794,651 propose as a measure for improving the mechanical strength of the fixed image a wet process developer, which comprises a toner dispersion of a colorant consisting primarily of a pigment and a thermoplastic resin wherein toner particles having a relatively large volume average particle size of several micrometers are dispersed in an aliphatic hydrocarbon.

However, in the case of a wet process developer comprising toner particles which contain a thermoplastic resin and are merely dispersed in an aliphatic hydrocarbon, it is necessary to completely evaporate the carrier contained in paper or in toner image so that the toner particles containing thermoplastic resin will be sufficiently fused, which will significantly decrease the fixing speed or will require a large amount of heat for the fixing treatment.

The first object of the present invention is to provide a developer for electrostatic photography, which developer brings about the advantages that fixing speed is not reduced, that a large amount of heat is not necessary, that the amount of carrier vapor discharged from a copier or printer can be reduced, that solvent odor peculiar to organic solvent is eliminated and that risk of fire is minimized.

The second object of the present invention is to provide a developer for electrostatic photography, which developer has an electrophoresis or fixing speed sufficiently high and always provides a high-quality image even after repeated use.

The third object of the present invention is to provide an image forming method whereby a high fixing speed is possible and a high-quality image is always obtained even in the case where a wet process developer, which requires a fusion, is used.

The fourth object of the present invention is to provide an image forming method whereby the amount of energy required for fixing treatment can be reduced and an image having a sufficiently high fixing strength can be obtained.

SUMMARY OF THE INVENTION

A developer for electrostatic photography according to the present invention comprises toner particles containing a thermoplastic resin and a colorant dispersed in an electrically insulating carrier having a melting point above room temperature wherein the thermoplastic resin is insoluble in the electrically insulating carrier at a temperature below the melting point of the electrically insulating carrier but becomes solvated with the electrically insulating carrier at a temperature above the melting point of the electrically insulating carrier.

In the present invention, the toner particles preferably have a volume average particle diameter in the range of 0.5 to 10 μm and contain an electrostatic charge controller. The temperature at which the salvation of the thermoplastic resin of the toner particles with the electrically insulating carrier starts is preferably in the range of 50° to 100° C. The thermoplastic resin is preferably an ethylenic polymer and is selected particularly from the group consisting of a copolymer of ethylene with an α,β-unsaturated carboxylic acid or with an ester thereof and a copolymer of ethylene with vinyl acetate. Preferably, the electrically insulating carrier has a melting point in the range of 20° to 80° C. and preferably is selected from an alkane. And, the electrically insulating carrier preferably contains a charge director.

The image forming method according to the present invention comprises the steps of manifesting an electrostatic latent image on an electrostatic latent image support by use of a developer for electrostatic photography and fixing the toner image to a recording material wherein the developer for electrostatic photography comprises toner particles, which contain a colorant and a thermoplastic resin, in a state dispersed in a carrier having a melting point above room temperature, wherein the thermoplastic resin becomes solvated with the carrier at a temperature above the melting point, and wherein the image manifesting process comprises the steps of bringing the developer for electrostatic photography into contact with the electrostatic latent image support while holding the developer for electrostatic photography at a temperature which is above the melting point of the electrically insulating carrier but below the point at which the thermoplastic resin starts the salvation with the electrically insulating carrier so that the toner particles contained in the developer for electrostatic photography will adhere to the electrostatic latent image.

In the above-described image forming method, the step of fixing the toner image to the recording material preferably comprises fixing a manifest toner image to the recording material at a temperature above the point at which the thermoplastic resin starts the salvation with the electrically insulating carrier.

Since the developer for electrostatic photography according to the present invention utilizes as an electrically insulating carrier a highly insulating hydrocarbon having a melting point above room temperature, the amount of carrier vapor discharged from a copier or printer using this developer can be reduced, solvent odor peculiar to organic solvent is eliminated and the risk of fire is minimized. Since the electrically insulating carrier has a low viscosity in a fused state and does not interfere with the electrophoresis of the toner particles and since the toner particles can have a larger diameter, the developer for electrostatic photography according to the present invention provides a high speed of electrophoresis and always a high-quality image even after repeated use. Since the thermoplastic resin itself of the toner particles fixes on the recording paper, an image having a sufficiently high fixing strength can be obtained. Further, since the thermoplastic resin of the toner particles becomes solvated with the electrically insulating carrier at or above a predetermined temperature, fixability at a low temperature is markedly improved.

The above-mentioned advantages can also be obtained in the image forming method of the present invention wherein a developer for electrostatic photography according to the present invention is used.

DESCRIPTION OF THE PREFERRED EMBODIMENTS

Figure 1:
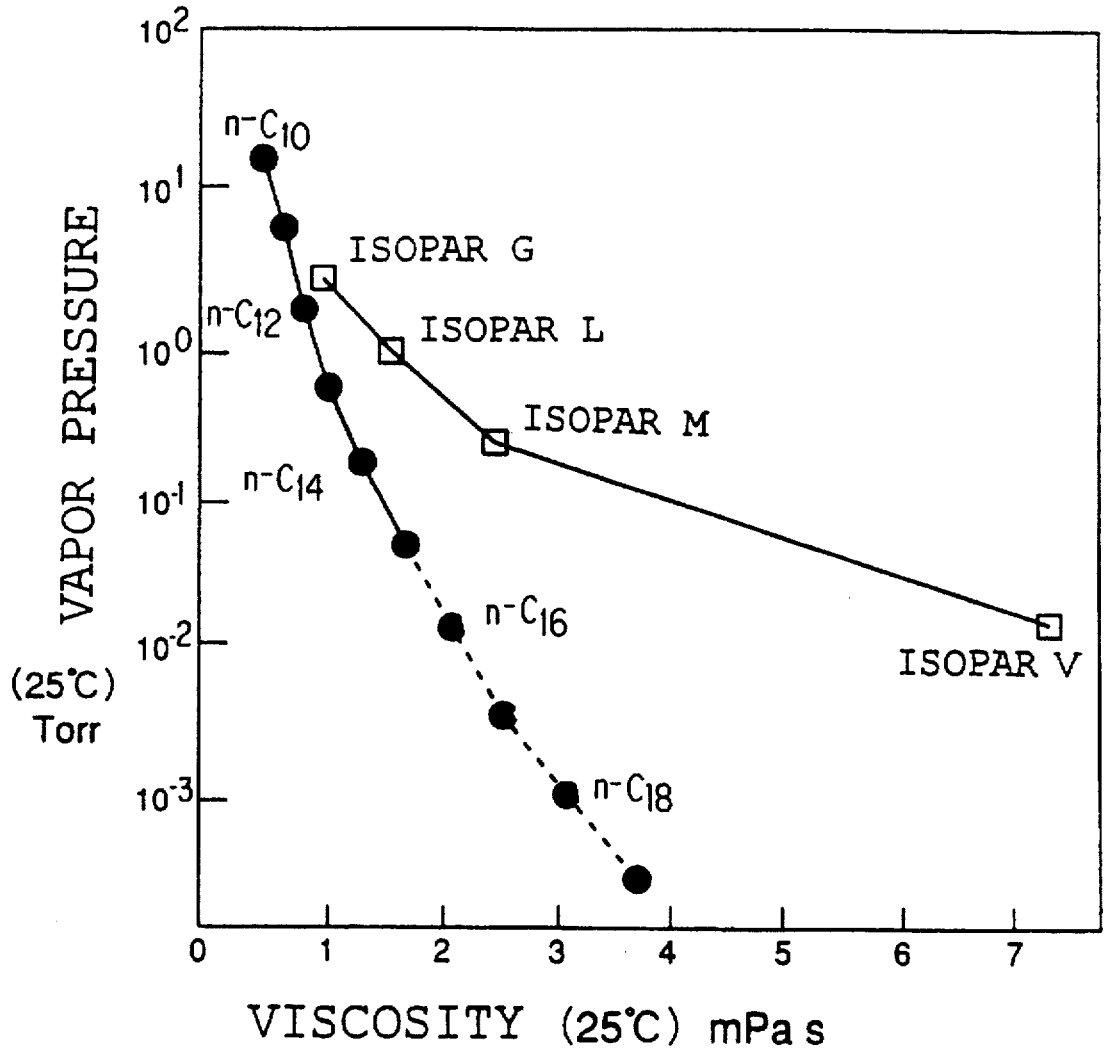
FIG. 1 shows graphs illustrating a relationship between vapor pressure and viscosity at 25° C. of an alkane which is an electrically insulating carrier to be used in the present invention and of an isoparaffin as a substance of control.

The present invention is explained in detail below.

The developer for electrostatic photography according to the present invention consists essentially of a toner and an electrically insulating carrier. The electrically insulating carrier preferably contains a charge director.

As used herein, "developer" for electrostatic photography means one which is in a liquid state at the time of developing treatment and includes one which is a solid at room temperature. The term "essentially" means inclusion into the composition of an ingredient which does not diminish the advantages of the developer of the present invention. Therefore, the developer for electrostatic photography according to the present invention may contain, in addition to the toner and the electrically insulating carrier, other auxiliary ingredients which include a finely divided metal soap, metal oxide and additive.

As used herein, "charge controller" means a substance which is present on and inside toner particles to present a site for generating a charge.

As used herein, "charge director" means a substance which is present in the electrically insulating carrier to stabilize the charge exchange between toner particles and the electrically insulating carrier. For example, in the case where a charge controller in toner particles is a substance having a salt structure, presumably the counter ion is stabilized by the charge director in the electrically insulating carrier so that the charge exchange between toner particles and the electrically insulating carrier is promoted and stabilized.

As used herein, "salvation" means a phenomenon in which a molecule or ion of the thermoplastic resin attracts some of adjacent molecules of solvent to jointly form a molecular group and is distinguished from a simple dissolution.

As used herein, "salvation temperature" means a temperature which causes a thermoplastic resin constituting toner particles to undergo an abrupt volume change before reaching a temperature at which the thermoplastic resin constituting toner particles becomes soluble in the solvent. More specifically, in the case where a mixture of a thermoplastic resin powder and an electrically insulating carrier of the present invention is heated up under agitation, the volume of the mixture exhibits an abrupt increase at or above a certain temperature to generate a phase apparently different from a solid/liquid dispersion phase before the temperature is reached. This temperature is herein referred to as "salvation temperature". The above-mentioned temperature is observed in a range of several to tens °C., although it varies depending on agitating energies and combinations of thermoplastic resins and electrically insulating carriers. As the temperature of the mixture is further raised, the thermoplastic resin will be dissolved in the electrically insulating carrier and, as a result, the volume of the mixture will decrease. Accordingly, a "salvation" phenomenon, in which a resin is solvated with an electrically insulating carrier, is clearly distinguishable from a "dissolution" phenomenon by observing a change in phase and a change in volume.

The "salvation temperature" can be obtained by measuring temperature while observing the change of phase. Alternatively, it can be presumed from a shoulder temperature of DSC by effecting DSC (Differential Scanning Calorimetry) of a mixture of a thermoplastic resin and an electrically insulating carrier, as described hereinbelow.

Toner particles to be used in a developer for electrostatic photography will be explained below. The toner particles comprise a thermoplastic resin and a colorant. Preferably, the toner particles further comprise a charge controller.

The thermoplastic resin is insoluble in the electrically insulating carrier at a temperature below the melting point of the electrically insulating carrier but becomes solvated with the electrically insulating carrier at a temperature above the melting point of the electrically insulating carrier.

Usable as an indicator for selecting a combination of electrically insulating carrier and a thermoplastic resin, which becomes solvated with the electrically insulating carrier at a predetermined temperature, is an SP value. That is, the above-mentioned "salvation" is possible for a combination in which an SP value of the electrically insulating carrier and an SP value of the thermoplastic resin are close to each other (for example, the difference between the two SPs is not greater than 2).

The type of a thermoplastic resin is not particularly restricted in so far as it becomes solvated with the aforementioned carrier when it is mixed with the carrier and heated. A suitable example of a thermoplastic resin is an ethylenic copolymer. For example, it is an ethylene/vinyl acetate copolymer, a copolymer of ethylene with an α,β-unsaturated carboxylic acid selected from the group consisting of acrylic acid and methacrylic acid, a copolymer of ethylene with an alkyl ester of acrylic acid or methacrylic acid, or an ionomer prepared by ion-crosslinking any of the foregoing copolymers, because the foregoing resins can be "solvated" with a nonpolar hydrocarbon traditionally and commonly used as an electrically insulating carrier in a developer for electrostatic photography. Methods for preparing these copolymers are described, for example, in the specification of U.S. Pat. No. 3,264,272 issued to Rees.

In the present invention, by selecting an electrically insulating carrier having a suitable SP value, other thermoplastic resins can also be used which include a homopolymer of such monomer as styrene, o-,m- or p-methylstyrene, α-methylstyrene, p-ethylstyrene or 2,4-dimethylstyrene, a copolymer of styrene with an acrylic monomer and a copolymer of styrene with other monomer.

Examples of an acrylic monomer which produces a styrene/acrylic copolymer are an ester, a betaine compound and an ammonium salt of an α-methylenemonocarboxylic acid such as methyl acrylate, methyl methacrylate (hereinafter "acrylic acid" and "methacrylic acid" are collectively referred to as "(meth)acrylic acid"), ethyl (meth) acrylate, propyl (meth)acrylate, n-butyl (meth)acrylate, isobutyl (meth)acrylate, n-octyl (meth)acrylate, dodecyl (meth)acrylate, lauryl (meth)acrylate, 2-ethylhexyl (meth) acrylate, stearyl (meth)acrylate, 2-chloroethyl (meth) acrylate, phenyl (meth)acrylate, dimethylaminoethyl (meth) acrylate or diethylaminoethyl (meth)acrylate.

In the present invention, suitable as the above-mentioned thermoplastic resin are a homopolymer or a copolymer of the above-mentioned acrylic monomer or otherwise a homopolymer or a copolymer of such monomer as perfluorooctyl (meth)acrylate, vinyltoluenesulfonic acid, sodium salt of vinyltoluenesulfonic acid, a vinylpyridine or a vinylpyridinium salt. Also suitable as the above-mentioned thermoplastic resin are a polyamide resin based on a dimeric acid and a copolymer of a diene such as butadiene or isoprene with a vinyl monomer. Further, examples of a usable thermoplastic resin are a polyester or a polyurethane in a form of a single resin or in a combination with any of the aforementioned resins.

Usable as a colorant are known organic or inorganic pigments or dyes, oil soluble dyes and the like. Examples of a colorant are C.I. Pigment Red 48:1, C.I. Pigment Red 57:1, C.I. Pigment Red 122, C.I. Pigment Red 17, C.I. Pigment Yellow 97, C.I. Pigment Yellow 12, C.I. Pigment Blue 15:1, C.I. Pigment Blue 15:3, Lamp Black(C.I.No.77266), Rose Bengal(C.I.No.45432), Carbon Black, Nigrosine Dye (C.I.No.50415B), Magenta Pigment, a metal complex dye or pigment, a derivative of a metal complex dye or pigment, and a mixture of the foregoing. Further examples are a metal oxide such as silica, aluminum oxide, a magnetite or ferrite, cupric oxide, nickel oxide, zinc oxide, zirconium oxide, titanium oxide and magnesium oxide as well as a mixture of the foregoing.

Such a colorant is used in an amount which enables the formation of a visible image having a sufficient density. Generally, a suitable amount of an colorant to be used is 1–200 parts by weight based on 100 parts by weight of a thermoplastic resin, although the amount of an colorant varies depending on toner particle size or on the amount of image to be developed.

In a developer for electrostatic photography of the present invention, toner particles preferably contain a charge controller. A charge controller usable herein includes any of the charge controllers which have been used in a conventional developer. Among these charge controllers, particularly preferred is a compound utilized in a powdery toner for xerography, which is selected from the group consisting of a metal salt of benzoic acid, a metal salt of salicylic acid, a metal salt of an alkylsalicylic acid, a metal salt of catecol, a metal-containing bisazo dye, a tetraphenyl borate derivative, a quaternary ammonium salt and an alkyl pyridinium salt. The charge controller may be used alone or in a combination of two or more of them.

Generally, a suitable amount of a charge controller to be used is 0.1–10 percent by weight based on the amount of toner particles, and preferably 0.5–8 percent by weight based on the amount of toner particles. An amount less than 0.1 percent by weight cannot bring about a sufficient charge controlling effect, whereas an amount exceeding 10 percent by weight undesirably leads to an excessively high conductivity of a developer for electrostatic photography.

In the present invention, the above-mentioned charge controller can be used in combination with a metallic soap, or with an inorganic or organic metal salt.

Examples of the metallic soap are aluminum tristearate, aluminum distearate, barium stearate, calcium stearate, lead stearate, zinc stearate, cobalt linolenate, manganese linolenate, lead linolenate, zinc linolenate, aluminum octanoate, calcium octanoate, cobalt octanoate, calcium oleate, cobalt oleate, zinc palmitate, calcium naphthenate, cobalt naphthenate, maganese naphthenate, lead naphthenate, zinc naphthenate, calcium resinate, cobalt resinate, manganese resinate and zinc resinate. Although these metallic soaps have a charge controlling property, they are useful because they improve the dispersibility of toner particles.

Examples of the inorganic or organic metal salt are a halide, a carbonate, an acetate, a sulfate, a borate, a nitrate and a phosphate having as a cationic component thereof a metal selected from Groups I, II and XIII of Periodic Table (revised IUPAC rules of nomenclature for inorganic chemistry, 1989).

An electrically insulating carrier to be used in a developer for electrostatic photography is explained below. The electrically insulating carrier has a high electric resistance, preferably in the range of $10^8$ to $10^{12}$ Ωcm.

The above-mentioned electrically insulating carrier has a melting point which is not below room temperature and melts by heating.

By taking into account a general use environment and ease in handling, the solidifying point of the electrically insulating carrier is preferably not lower than 20° C. and more preferably not lower than 30° C. Although an upper limit of the solidifying point is not particularly specified, the solidifying point is practically not higher than 80° C., preferably not higher than 60° C., more preferably not higher than 40° C.

If the melting point of the electrically insulating carrier is denoted by Tm(carrier) and the temperature at which the thermoplastic resin of dispersed toner particles starts solvation with the electrically insulating carrier is denoted by Ts (toner), Tm(carrier) which is greater than Ts(toner) causes the toner particles to swell or gel, thereby increasing particle diameters or coagulating the toner particles, depending on the heating temperature T of the developer. It is preferred that the heating temperature T of the developer should meet the following relationship.

$$\text{Room temperature} \leq Tm(\text{carrier}) < T < Ts(\text{toner})$$

The above-mentioned electrically insulating carrier is mostly a nonpolar material having a high resistance and low dielectric constant. Since such a nonpolar material is a poor solvent for a common thermoplastic resin, it is difficult for such a nonpolar material to dissolve a thermoplastic resin even under heating.

However, since the thermoplastic resin of dispersed toner particles in a developer for electrostatic photography according to the present invention can be solvated with the electrically insulating carrier, the thermoplastic resin is plasticized either by a small amount of the electrically insulating carrier present between toner particles or by a small amount of the electrically insulating carrier taken into the thermoplastic resin. As a result, the properties of the thermoplastic resin before and after solvation significantly change. Particularly, the melt viscosity under heating is lowered and fixability at a low temperature is improved.

Ts (toner) is preferably in the range of from 40° to 100° C. and preferably in the range of 60° to 80° C., although it depends on the composition of the thermoplastic resin constituting the toner.

Examples of an electrically insulating carrier are a branched or linear aliphatic hydrocarbon paraffin or wax, a crystalline polymeric resin having a low molecular weight and a mixture of the foregoing. Among these, particularly preferred is a paraffin consisting primarily of an alkane which has a definite melting point and has a low viscosity after fusion.

A preferred paraffin is a normal paraffin selected from normal paraffins having about 18–40 carbon atoms which range from octadecane ($C_{18}H_{38}$, melting point 28.2° C.) to hexacontane ($C_{40}H_{82}$, melting point 81.5° C.). And, as stated previously, a particularly preferred paraffin has a melting point not higher than 40° C.

Examples of a wax are a vegetable wax, such as carnauba wax, cotton wax and wood wax, an animal wax, such as bees wax and lanolin, a mineral wax, such as ozokerite and ceresin, a petroleum wax, such as paraffin, microcrystalline and petrolatum. Besides these naturally occurring waxes, also usable are a synthetic hydrocarbon wax, such as Fischer-Tropsch wax and polyethylene wax, and a synthetic wax such as 12-hydroxystearic acid amide, stearic acid amide, phthalic anhydride imide, an fatty acid amide such as a chlorinated hydrocarbon, an ester, a ketone and an ether.

Examples of a crystalline polymeric resin having a low molecular weight are a crystalline polymer having a long alkyl group as a side chain exemplified by a polyacrylate based homopolymer, such as a poly(n-stearyl methacrylate) and a poly(n-lauryl methacrylate), or a copolymer such as a n-stearyl acrylate/ethyl methacrylate copolymer.

In addition, also usable is a halide of the above-mentioned branched or linear substances including a halogenated hydrocarbon such as a fluorocarbon compound.

FIG. 1 shows graphs illustrating a relationship between vapor pressure and viscosity at 25° C. of an alkane which is a preferred electrically insulating carrier to be used in the present invention and of an isoparaffin (Isopar available from Exxon Chemicals Corp.) as a substance of control. It is apparent from FIG. 1 that an alkane has a vapor pressure and viscosity sufficiently lower that those of an isoparaffin and that a n-alkane having a molecular weight greater than that of n-$C_{15}$(pentadecane) has a sufficiently low melt viscosity despite its melting point present in the neighborhood of room temperature and therefore exerts no adverse influence on the electrophoresis speed, thus preventing the reduction in the fixing speed.

charge director

A charge director to be incorporated into the above-described electrically insulating carrier is explained below.

Examples of an ionic or nonionic charge director, which is present in the above-described electrically insulating carrier and which is capable of forming a micelle, include a phospholipid, an oil-soluble petroleum-based sulfonate, an ionic or nonionic surfactant, a block or graft copolymer comprising a lipophilic portion and a hydrophilic portion and other compound having a cyclic, star or dendrimer skeleton. Among the foregoing substances, particularly preferred are a phospholipid or an oil-soluble petroleum-based sulfonate, which itself is thermally stable to the heating condition and to a thermal hysteresis of a developer for electrostatic photography and which stabilizes a cation to produce a stable dispersion in the case where a charge controller having a salt structure is employed, and a synthetic polymeric compound which can be relatively easily freed from impurities and is exemplified by a block or graft copolymer comprising a lipophilic and a hydrophilic portion.

Examples of a charge director include a phospholipid, such as lecithin and cefarin, an oil-soluble petroleum-based sulfonate, such as basic barium petronate, basic sodium petronate and basic calcium petronate available from Witoco Chemical Corp., and a polybutylene/succinimide such as OLOA-1200 available from Chevron Corp.

In a block or graft copolymer comprising a lipophilic portion and a hydrophilic portion, suitable as the lipophilic portion is a polymer made from such monomer as butadiene, isoprene or an alkyl ester of α,β-ethylenically unsaturated acid represented by acrylic acid or methacylic acid, while suitable as the hydrophilic portion is a quaternized trialkylamino polymer or pyridinium polymer. In addition, also suitable is a block copolymer of polyethylene glycol and polypropylene glycol. Such a block or graft copolymer comprising a lipophilic portion and a hydrophilic portion has a number average molecular weight as a whole in the range of 1,000 to 50,000. The structure of the block copolymer may be AB, ABA or BAB. The structure of the graft copolymer may be comb-shaped. Further, suitable are a cyclic polymer, such as a crown ether, a macrocyclic amine and a polynorbornene, and a compound having a polymer skeleton including a dendrimer such as a polyalkylamidealpolol.

Among examples of an ionic or nonionic surfactant, usable anion-active surfactants include an alkylbenzene sulfonic acid salt, an alkylphenyl sulfonic acid salt, an alkylnaphthalene sulfonic acid salt, a higher fatty acid salt, a sulfate salt of a higher fatty acid ester and a sulfonate salt of a higher fatty acid ester. Usable cation-active surfactants include a primary, secondary or tertiary amine salt and a quaternary ammonium salt. Usable nonion-active surfactants include a polyoxyethylene alkyl ether, such as a polyoxyethylene nonylphenyl ether, a polyoxyethylene octylphenyl ether and a polyoxyethylene dodecylphenyl ether, a polyoxyethylene fatty acid ester, a sorbitan fatty acid ester, a polyoxyethylene sorbitan fatty acid ester and a fatty acid alkylol amide.

A suitable amount of a charge director to be used is 0.01–20 percent by weight and preferably 0.01–10 percent by weight based on the amount of toner solids (toner particles). An amount less than 0.01 percent by weight cannot bring about a sufficient charge controlling effect, whereas an amount exceeding 20 percent by weight undesirably leads to an excessively high conductivity of a developer.

Besides, a suitable amount of a charge director to be used based on the weight of the electrically insulating carrier is 0.01–10 percent by weight and preferably 0.05–1 percent by weight based. An amount less than 0.01 percent by weight cannot bring about a sufficient charge controlling effect, whereas an amount exceeding 10 percent by weight undesirably leads to an excessively high conductivity of a developer.

In addition to the above-mentioned charge directors, any of other known additives to a developer can be used in order to control the properties of the developer for electrostatic photography. For example, a substance which may be dispersed or dissolved in the liquid of the developer for electrostatic photography includes a finely divided polymer or inorganic substance or a stabilizer protecting the electrically insulating carrier or charge director from such deterioration as thermal degradation and oxidation by light or humidity.

Further, in addition to the above-mentioned substances, a radical polymerization inhibitor may be incorporated into the developer in order to prevent an undesirable increase in viscosity due to a mutual polymerization of electrically insulating carrier molecules by a radical which will be generated as a result of repetition of heating→cooling of the electrically insulating carrier.

The type of the above-mentioned radical inhibitor is not particularly restricted in so far as it reduces the activity of a radical, and may be a radical polymerization inhibitor, a radical polymerization suppressor, a radical scavenger and a combination of the foregoing. Examples of a radical polymerization inhibitor include a sulfur compound such as dithiobenzoyl disulfide, a quinone, such a benzoquinone, naphtoquinone and anthraquinone, a hydroquinone which is a diol of the foregoing quinone, a catecol such as a t-butylcatecol, a polyoxy compound, an amine, diphenylpicryl hydrazine, a nitro compound, a nitroso compound such as N-(3-N-oxyanilino-1,3-dimethylbutylidene)aniline oxide, copper(II) chloride and picric acid.

Next, a method for preparing developer for electrostatic photography of the present invention is explained below.

The developer for electrostatic photography of the present invention can be prepared by a known method. It can be prepared, for example, by the aforementioned method of Metcalfe, by methods described in Japanese Patent Application Laid-Open (JP-A) Nos. 58-2,851, 58-129,438 and 58-152,258 or by a toner preparing method described in U.S. Pat. No. 4,794,651 issued to B. Landa et al. Besides, it can be prepared by a process comprising steps of weighing the aforementioned thermoplastic resin, pigment, charge controller and other components in a predetermined proportion, fusing the thermoplastic resin, blending the fused thermoplastic resin with the pigment, charge controller and other components to produce a dispersion, cooling the dispersion, comminuting the cooled dispersion utilizing a crusher such as a jet mill, a hammer mill or a turbo-mill to produce toner particles, and dispersing the obtained toner particles in an electrically insulating carrier which has been molten by heating in advance. Alternatively, it may be prepared by a process comprising steps of preparing a toner holding within the particles thereof a charge controller either by a polymerization method, such as a suspension polymerization, an emulsion polymerization or a dispersion polymerization, or by an appropriate method such as a coacervation, a melt dispersion or an emulsion coagulation, and dispersing the obtained toner particles in an electrically insulating carrier which has been molten by heating in advance.

Another method of preparation is based on the utilization of an appropriate equipment that allows to carry out a dispersing or blending process at a temperature which causes a thermoplastic resin to be plasticized but does not cause the electrically insulating resin to boil and which is lower than a decomposition temperature of the thermoplastic resin and/or colorant. More concretely, a toner can be prepared by a process comprising the steps of melt-blending a pigment and a thermoplastic resin into an electrically insulating carrier using a meteor-type mixer or a kneader and cooling down the blend under stirring to coagulate/deposit toner particles by utilizing the temperature dependence of the solubility of the thermoplastic resin in the carrier.

A further method of preparation comprises placing the above-mentioned ingredients in an appropriate vessel equipped with particulate media as a dispersing and blending means, e.g., a heated vibration mill such as an attritor or heated ball mill, and carrying out a dispersing and blending operation in a suitable temperature range, for example, at 80°–160° C. Preferred examples of the particulate media include those of steel, such as stainless steel or carbon steel, alumina, zirconium and silica.

When using this method for the preparation of a toner, the following process is effected: that is, the above-mentioned ingredients, which have been put into a fluid state in advance, are dispersed within a vessel by means of particulate media and the dispersed system is gradually cooled down to a temperature in the neighborhood of the melting point of the electrically insulating carrier so that toner particles containing a colorant and a charge controller are precipitated from the electrically insulating carrier. It is important to keep the particulate media in motion during and after the cooling stage to generate shearing and/or impacting force so that the toner particle sizes become smaller.

The concentration of toner in the developer for electrostatic photography is in the range of 0.1 to 15 percent by weight and preferably in the range of 0.5 to 2 percent by weight.

The toner comminuted by the above-described methods should have a desirable volume average particle diameter within the following range, as measured by a particle size distribution measuring apparatus based on centrifugal precipitation. For example, the average particle diameter is in the range of 0.5 to 10 μm and preferably in the range of 1 to 5 μm. A toner having a volume average particle diameter smaller than 0.5 μm makes the developing speed of the toner too slow to be applicable to a high-speed copier, whereas a toner having a volume average particle diameter greater than 10 μm makes it impossible to obtain a targeted high-quality image. The comminuted toner may take various shapes having fibers depending on requirements. "Shapes having fibers" means toner particles having fibers, curled beards, tentacles and the like.

Image forming method according to the present invention is explained below.

A known method adopted in electrophotography or electrostatic recording process can also be used for making a latent image on a latent imaging support in the image forming method according to the present invention.

The above-mentioned latent imaging support is not limited to a photosensitive body for electrophotography but can be a dielectric substance. For developing a latent image in the method according to the present invention, a known method utilizing a developer can be adopted. However, in the method according to the present invention, an electrically insulating carrier constituting the developer needs to be heated during the developing operation, because the electrically insulating carrier constituting the developer is solid at room temperature.

Figure 2:
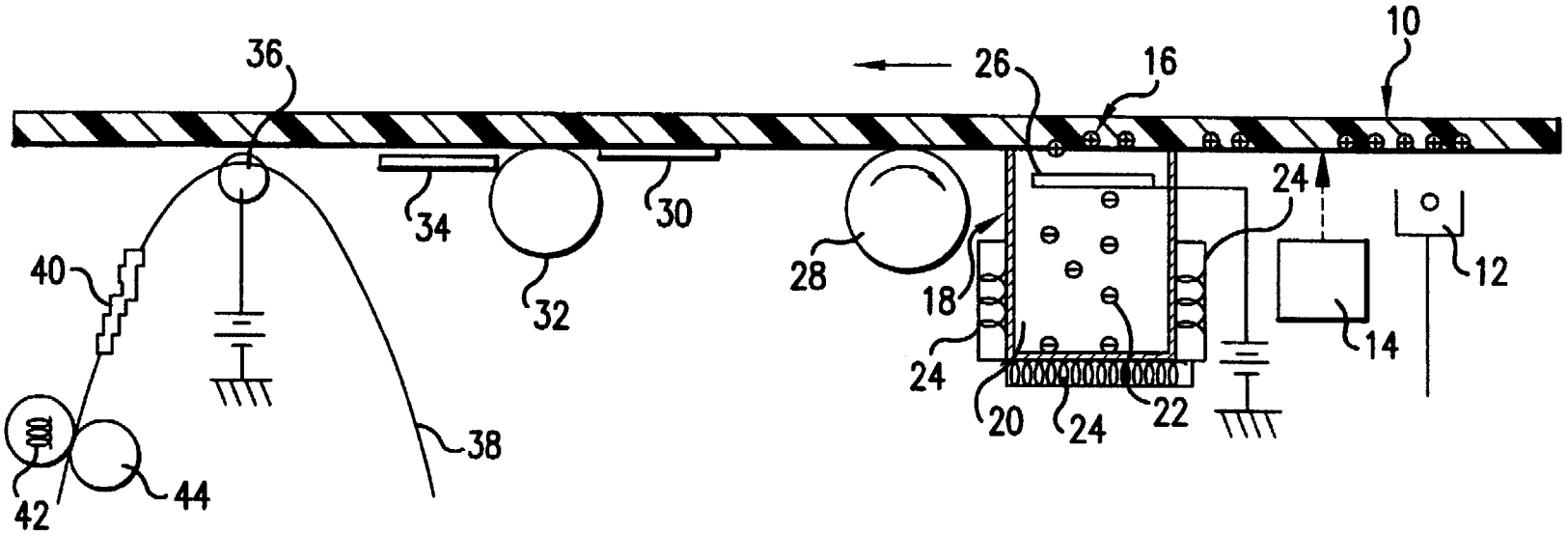
FIG. 2 is a schematic diagram illustrating an image forming method of the present invention utilizing a developer for electrostatic photography according to the present invention, where steps are shown which range from a charging stage, a developing stage, to a fixing stage of a developed toner image.

Image forming method according to the present invention is explained by way of an embodiment. FIG. 2 is a schematic diagram illustrating the formation of an image by use of a developer for electrostatic photography according to the present invention. The illustrated process ranges from a charging stage to a developing stage and finally to a fixing stage where a developed toner image is fixed.

As a matter of convenience, a photosensitive body 10 in FIG. 2 is shown as a long sheet of photosensitive body, which undergoes a series of treating steps. However, the photosensitive body can take an annular shape in an actual system.

In a charging stage of FIG. 2, a photosensitive body 10 is uniformly charged, for example, with a plus charge by use of an appropriate charging means such as a corona discharger 12. Then, in a developing stage, the plus charge of a region corresponding to image information is eliminated by use of an appropriate exposing means such as a semiconductor laser light 14.

Next, a developing stage consists in passing an electrostatic latent image 16, which has been formed in the preceding stage, over a developer tank 18 containing a developer for electrostatic photography. The developer comprises an electrically insulating carrier 20 which is solid at room temperature and which has minus-charged toner particles 22 dispersed therein. Because of the heat from a heating means 24 such as a heater, the developer is fused and is in a state of liquid. Owing to a potential difference between a developing electrode 26 and a photosensitive body 10, the fused developer is subjected to electrophoresis to effect development. An excess of carrier 20 is squeezed out by a metering roll 28.

Further, the carrier 20 is squeezed from a developed toner image 30 by means of an image stabilization roll 32. The image stabilization roll 32 has a rigid surface, which is, for example, a metal or ceramics covered with a foam skin layer, such as a polyurethane or silicone layer, having minute holes. The developed toner image 30 is directly press-contacted with the image stabilization roll 32, which squeezes out the carrier 20 by means of a capillary suction or by means of a vacuum suction through the voids on the roll. A pre-transfer toner image 34 is transferred to a transfer paper 38 via a backup roll 36. And, a transferred toner image 40 is fixed by a fixing roll 42 to a recording paper 38, which has been heated to a temperature not lower than Ts, between the fixing roll 42 and a pressing roll 44.

In the image forming method of the present invention, the ratio of toner to electrically insulating carrier (concentration by weight percent of toner in a developer for electrostatic photography) varies depending on the particles sizes of the toner, but it is in the range of 0.1 to 5 percent by weight in the developer tank 18, in range of 10 to 20 percent by weight in the developed toner image 30, and in the range of 30 to 50 percent by weight in the pre-transfer image 34.

As stated above, since the developer for electrostatic photography according to the present invention utilizes as an electrically insulating carrier an organic compound which is solid at room temperature, the vapor pressure of the electrically insulating carrier liquid is markedly lower than that of conventional carrier, the image from a copier or printer is free of solvent odor peculiar to organic solvent and the risk of fire is minimized. Since the toner particles contain a thermoplastic resin which becomes solvated with the electrically insulating carrier, the developer for electrostatic photography according to the present invention enables a high-speed fixation and at a lower fixing temperature. In addition, it is possible to realize a high-quality image formation even after repeated use of the developer and to maintain an excellent image quality after lapse of time.

Therefore, the developer for electrostatic photography according to the present invention is satisfactory is practical use. In addition, the image forming method by use of the developer for electrostatic photography according to the present invention provides the advantages that the strength of the fixed image is sufficiently high and the amount of the energy required for the fixation can be reduced.

The present invention will be further clarified by the following examples, which should not be viewed as a limitation on any embodiment of the invention. "Part" means "part by weight" and "%" means "weight %" unless otherwise specified.

EXAMPLE 1

A developer was prepared in the following way.

| | | |
|---|---|---|
| 1. | Ethylene (89%)/methacrylic acid (11%) copolymer (Newclel N699 from E. I. Dupont de Nemours and Co.) | 40 parts |
| 2. | Copper phthalocyanine pigment (Cyanine Blue 4933M from Dainichiseika Color & Chemicals Mfg. Co., Ltd.) | 8 parts |
| 3. | Charge controller (aluminum salt of 3,5-di-t-butyl salicylic acid) | 2 parts |
| 4. | Dispersing medium (Norpar 15 from Exxon Corp.) | 100 parts |

The ingredients 1–3 were placed in a stainless steel beaker and stirred for one hour at 120° C. by means of an oil bath to prepare a uniform melt of a completely fused resin and a pigment. The melt was gradually cooled down to room temperature and 100 parts of the above-described Norpar 15 indicated by a numeral 4 was added to the melt. As the temperature of the melt drops, toner mother particles, which contained a pigment and a charge controller and were in 10–20 μm diameter, deposited. 100 g of the obtained toner mother particles was placed in an attritor (Model 01 from Mitsui Miike Machinery Co., Ltd.) and was ground for 20 hours by use of rigid steel balls having a diameter of 0.8 mm at 300 rpm of rotor. The grinding operation was carried out until d=2.5 μm was obtained, while monitoring a volume average particle diameter by a particle size distribution measuring apparatus based on centrifugal precipitation (SA-CP4L from Shimadzu Corporation). In this way, a pasty toner concentrate was obtained, which was used as a base toner.

20 parts of the base toner (having a toner concentration of 18%) was diluted with 160 parts of eicosane ($C_{20}H_{42}$, melting point 36.8° C.) serving as an electrically insulating carrier, which had been heated to 75° C. and was in a fused state, to produce a toner concentration of 2 percent based on the developer liquid, and the resultant mixture was sufficiently stirred. The liquid thus prepared was admixed, calculated with respect to one part of the toner in the liquid, with 0.1 part of basic barium petronate (Basic Barium Petronate from Witoco Chemical Corp.) as a charge director.

The resultant mixture was sufficiently stirred and then placed in a stainless steel vat. In this way, a developer for electrostatic photography was prepared.

The measurement of the amount of toner brought into a developed state was effected in an environment of 40° C. enclosing a developer for electrostatic photography and a whole set of the measuring system. In this case, the melting point Tm of eicosane serving as an electrically insulating carrier was 36.8° C. and the observed temperature at which the salvation started Ts was 70° C.

EXAMPLE 2

A developer was prepared in the following way.

| | | |
|---|---|---|
| 1. | Ethylene/methacrylic acid copolymer (Newclel N599 from E. I. Dupont de Nemours and Co.) | 40 parts |
| 2. | Magenta pigment (Fanal Pink from Dainichiseika Color & Chemicals Mfg. Co., Ltd.) | 10 parts |
| 3. | Charge controller (aluminum stearate) | 2 parts |
| | Dispersing medium (Norpar 15 from Exxon Corp.) | 100 parts |

The ingredients 1–4 were placed in a Union Process grinding machine equipped with carbon steel balls having a diameter of 0.1857 inch. The ingredients were stirred for one hour at a temperature of 70° to 100° C. by means of steam passing through the jacket of the grinding machine and thereafter cooled down to 20° C. by means of water flowing through the jacket of the grinding machine, while the ingredients were stirred. This grinding operation was continued for 4 hours and a pasty concentrate of toner was obtained. The obtained toner had a volume average particle diameter of 2.1 μm.

20 parts of the base toner (having a toner concentration of 18%) was diluted with 160 parts of triacontane ($C_{30}H_{62}$, melting point 65.8° C.) serving as an electrically insulating carrier, which had been heated to 75° C. and was in a fused state, to produce a toner concentration of 2 percent based on the developer liquid and the resultant mixture was sufficiently stirred. The liquid thus prepared was admixed, calculated with respect to one part of the toner in the liquid, with 0.1 part of basic barium petronate as a charge director as in Example 1. The resultant mixture was sufficiently stirred and then placed in a stainless steel vat. In this way, a developer for electrostatic photography was prepared. In this case, the melting point Tm of triacontane serving as an electrically insulating carrier was 65.8° C. and the observed temperature at which the salvation started Ts was 80° C.

EXAMPLE 3

A developer was prepared in the following way.

| | | |
|---|---|---|
| 1. | Ethylene/vinyl acetate copolymer (Duramin from Takeda Chemical Industries, Ltd.) | 40 parts |
| 2. | Yellow pigment (Libnol Yellow FG1310 from Toyo Ink Manufacturing Co., Ltd.) | 10 parts |
| 3. | Charge controller (potassium salt of tetraphenyl borate) | 2 parts |
| 4. | Dispersing medium (Norpar 15 from Exxon. Corp.) | 100 parts |

The ingredients 1–3 were placed in a jacketed mixer (Double Planetary Mixer Model DP-5 from Tokushu Kakoki Kogyo Co., Ltd.) and stirred for one hour at 115° C. Then, 100 parts of the above-described Norpar 15 indicated by a numeral 4, which had been heated to 120° C., was added to the mixture and the resultant mixture was further stirred for one hour. Next, the mixture was cooled down at a rate of about 30° C. per hour by means of heat medium in the jacket. The toner particle started depositing at about 70° C. The obtained base toner particles had a volume average diameter of 1.9 μm. The base toner was subjected to a concentrating treatment by means of a centrifugal separator at 10,000 rpm for 20 minutes to obtain a concentrate of toner having a concentration of 30 percent.

The above-described concentrate of toner was diluted with pentacosane ($C_{25}H_{52}$, melting point 53.7° C.), which had been heated to 75° C. and was in a fused state, to produce a toner concentration of 2 percent and the resultant mixture was sufficiently stirred. The liquid thus prepared was admixed, calculated with respect to one part of the toner in the liquid, with 0.1 part of basic barium petronate as a charge director. The resultant mixture was sufficiently stirred and then placed in a stainless steel vat. In this way, a developer for electrostatic photography was prepared. In this case, the melting point Tm of pentacosane serving as an electrically insulating carrier was 53.7° C. and the observed temperature at which the salvation started Ts was 70° C.

EXAMPLE 4

20 parts of the base toner, which was obtained according to Example 1, was diluted with 160 parts of triacontane ($C_{30}H_{62}$, melting point 65.8° C.), which had been heated to 75° C. and was in a fused state, to produce a solids concentration of 2 percent and the resultant mixture was sufficiently stirred. The liquid thus prepared was admixed, calculated with respect to one part of the toner in the liquid, with 0.1 part of soybean lecithin as a charge director as in Example 1. The resultant mixture was sufficiently stirred and then placed in a stainless steel vat. In this way, a developer for electrostatic photography was prepared.

EXAMPLE 5

A concentrate of toner was prepared as in Example 2, except that Pigment Yellow 17 (from Dainichiseika Color & Chemicals Mfg. Co., Ltd.) was used as a pigment and cetyl pyridinium chloride was used as a charge controller for base toner. The obtained base toner particles had a volume average diameter of 1.8 μm.

20 parts of the above-described concentrate of toner (having a concentration of toner of 18 percent) was diluted with 160 parts of pentacosane ($C_{25}H_{52}$, melting point 53.7° C.), which had been heated to 75° C. and was in a fused state, to produce a toner concentration of 2 percent based on the developer liquid and the resultant mixture was sufficiently stirred as in Example 1. The liquid thus prepared was admixed with sodium dioctylsulfosuccinate as a charge director as in example 2. The resultant mixture was sufficiently stirred and then placed in a stainless steel vat. In this way, a developer for electrostatic photography was prepared.

EXAMPLE 6

A developer for electrostatic photography was prepared using the base toner of Example 1 as in Example 1, except that the following ionic copolymer was used as a charge director:

An AB-type diblock copolymer made from (A) lauryl methacrylate and (B) a 4-vinylpyridine quaternized with p-methyltoluene sulfonate, wherein A block has a number average molecular weight of 8000 and B block has a number average molecular weight of 2000 and the quaternization ratio is 98%.

EXAMPLE 7

A developer for electrostatic photography was prepared using the base toner of Example 2 as in Example 2, except that a nonionic surfactant having the following structure was used as a charge director:

charge director: $C_{16}H_{33}$—$O(CH_2CH_2O)_6$—H

COMPARATIVE EXAMPLE 1

A developer was prepared in the following way.

| | | |
|---|---|---|
| 1. | Polyester resin (obtained by polycondensation of terephthalic acid and ethylene oxide bisphenol A adduct; weight average molecular weight: 12000; oxidation degree: 5; softening point: 130° C.) | 85 parts |
| 2. | Magenta pigment (Carmin 6B from Dainichiseika Color & Chemicals Mfg. Co., Ltd.) | 15 parts |

The above-identified ingredients were blended by means of an extruder and comminuted by means of a jet mill. After the classification by wind of the obtained powder, a toner having a volume average particle diameter of 3 μm was obtained.

The toner particles thus obtained were dispersed in a paraffin wax (Paraffin Wax 120 from Nippon Seiro Co., Ltd. having a melting point of about 50° C.), which had been heated to 100° C. and was in a fused state, to produce a toner concentration of 2 percent. The liquid thus prepared was admixed with the same amount of basic sodium petronate as a charge director as in Example 1 and the resultant mixture was sufficiently stirred. The resultant mixture was sufficiently stirred and then placed in a stainless steel vat. In this way, a developer for electrostatic photography was prepared.

COMPARATIVE EXAMPLE 2

A concentrate of toner was prepared as in Example 1, except that a chromiun-containing dye (Spilon Black TRH from Hodogaya Chemical Co., Ltd.) was used as a charge controller and carbon black (Carbon Black #4000 from Mitsubishi Chemical Industries Limited) was used as a pigment.

The toner particles thus obtained were dispersed in a paraffin wax (Paraffin Wax 120 from Nippon Seiro Co., Ltd. having a melting point of about 50° C.), which had been heated to 100° C. and was in a fused state, to produce a toner concentration of 2 percent. The liquid thus prepared was admixed with the same amount of soybean lecithin as a charge director as in Example 1 and the resultant mixture was sufficiently stirred. In this way, a developer for electrostatic photography was prepared.

The obtained developers of Examples 1–6 and of Comparative Examples 1–2 were evaluated according to the following criteria.

Table 1 shows the compositions of the developers.

TABLE 1

| | Composition of Toner | | | Composition Of Carrier | | |
|---|---|---|---|---|---|---|
| | Resin Of Toner | Pigment | Charge Controller | Carrier Substance | Charge Director | Polarity Of Charged Toner |
| Ex. 1 | ethylene/ methacrylate copolymer | copper phthalocyanine | aluminum 3,5-di-tert-butyl salicylate | eicosane | basic barium petronate | negative |
| Ex. 2 | ethylene/ methacrylate copolymer | fanal pink | aluminum stearate | triacontane | basic sodium petronate | negative |
| Ex. 3 | ethylene/vinyl acetate copolymer | lionol yellow FG1310 | potassium tetraphenylborate | pentacosane | basic barium petronate | negative |
| Ex. 4 | ethylene/ methacrylate copolymer | copper phthalocyanine | aluminum 3,5-di-tert-butyl salicylate | triacontane | soybean lecithin | negative |
| Ex. 5 | ethylene/ methacrylate copolymer | pigment yellow 17 | cetylpyridinium chloride | pentacosane | sodium dioctylsulfosuccinate | positive |
| Ex. 6 | ethylene/ methacrylate copolymer | copper phthalocyanine | aluminum 3,5-di-tert-butyl salicylate | pentacosane | AB block copolymer of Example 6 | negative |
| Ex. 7 | ethylene/ methacrylate copolymer | fanal pink | aluminum stearate | triacontane | nonionic surfactant of Example 7 | negative |
| Comp. Ex. 1 | polyester resin | carmin 6B | nil | paraffin wax 120 | basic sodium petronate | insignificantly negative |
| Comp. Ex. 2 | ethylene/ methacrylate copolymer | carbon black #4000 | spilon black TRH | paraffin wax 120 | soybean lecithin | negative |

(Evaluation of developer)

Figure 3:
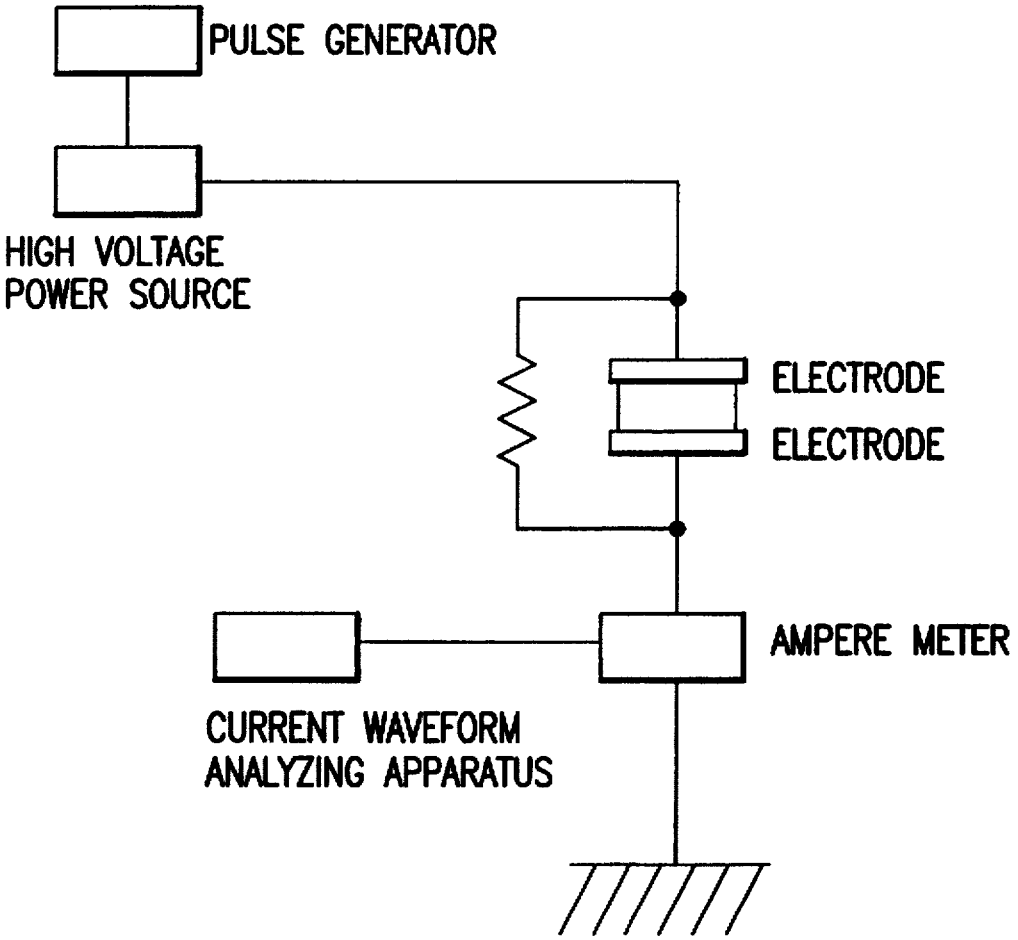
FIG. 3 shows a circuit of an instrument for the measurement of toner amount brought into a developed state for a developer for electrostatic photography.

(1) Determination of the polarity of the charged toner particles of developer and measurement of the amount of plus-directed toner particles and the amount of minus-directed toner particles The gap between parallel flat electrodes having each a diameter of 10 cm and holding a space of 1 mm therebetween (electrode area:78 $cm^2$) was filled with 3 ml of a developer, and a voltage of 1,000V was applied for one second so that the electric field of $+10^4$V/cm would be produced. Then, the electrode having toner adhered thereto was placed in a vacuum drying apparatus and was dried at 120° C. for 2 hours to completely eliminate the carrier liquid. The amount of plus-directed toner brought into a developed state was obtained from the difference in weight of the electrode before and after the adhesion of the toner. Next, the polarity of the applied voltage was reversed (electric field of $-10^4$V/cm) and the same procedure was repeated to measure the amount of minus-directed toner. The results are shown in Table 2. FIG. 3 illustrates a circuit of an apparatus for the measurement of the developed toner amount for use herein.

(2) Examination of salvation

An electrically insulating carrier having toner particles dispersed therein was gradually heated up and an abrupt volume change and phase change were visually checked. The results are shown in Table 2.

TABLE 2

| | Determination of Solvation | Amount of Plus-Directed Toner (mg) | | Amount of Minus-Directed Toner (mg) | |
|---|---|---|---|---|---|
| | | Immediately After Preparation | 7 Days After | Immediately After Preparation | 7 Days After |
| Ex. 1 | solvated | 24.1 | 22.0 | 0.1 | 0.1 |
| Ex. 2 | solvated | 25.3 | 21.3 | 0.0 | 0.2 |
| Ex. 3 | solvated | 33.6 | 32.2 | 0.2 | 0.2 |

TABLE 2-continued

| | Determination of Solvation | Amount of Plus-Directed Toner (mg) | | Amount of Minus-Directed Toner (mg) | |
|---|---|---|---|---|---|
| | | Immediately After Preparation | 7 Days After | Immediately After Preparation | 7 Days After |
| Ex. 4 | solvated | 31.1 | 30.2 | 0.2 | 0.2 |
| Ex. 5 | solvated | 22.9 | 20.2 | 0.1 | 0.1 |
| Ex. 6 | solvated | 34.6 | 31.5 | 0.1 | 0.1 |
| Ex. 7 | solvated | 29.6 | 28.0 | 0.1 | 0.1 |
| Comp. Ex. 1 | non-solvated | 11.6 | 7.3 | 0.5 | 4.3 |
| Comp. Ex. 2 | not apparent | 15.7 | 9.8 | 0.9 | 1.1 |

As is obvious from Table 2, the developers for electrostatic photography according to the present invention as embodied by Examples 1–6 provide negatively charged toners including a minor quantity of minus-directed toner particles. Because of a sufficient toner amount brought to the developed state, an excellent image is sure to be created. These developers for electrostatic photography exhibited the same performance level even 7 days after preparation, thus ensuring stabilized toner properties.

On the other hand, the developer of Comparative Example 1 bears an insignificant negative charge and the toner amount brought into the developed state was less than half to one third of that of any of Examples, thus hinting at an inferior quality of image. Besides., the examination of the developer 7 days after preparation revealed the increase in the quantity of minus-directed toner particles.

Figure 4:
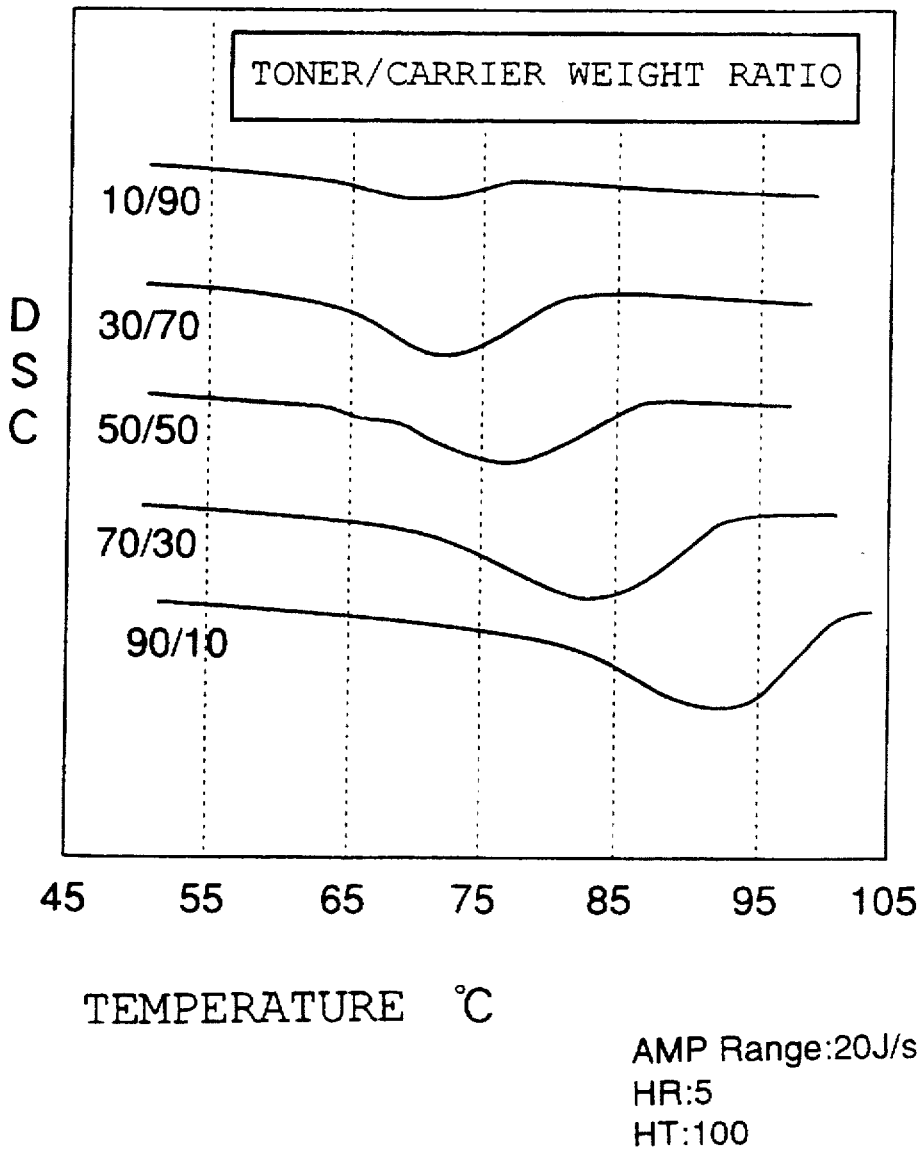
FIG. 4 is graphs illustrating DSC data for various weight ratios between the amount of the thermoplastic resin and the amount of the electrically insulating carrier of the developer for electrostatic photography according to Example 1.

(3) Analysis of thermal properties of the resins used for the preparation of toner DSC (Differential Scanning Calorimetry) of a mixture of the thermoplastic resin and electrically insulating carrier used in Example 1 was measured. FIG. 4 shows graphs illustrating the result of DSC wherein the weight ratio of the thermoplastic resin to the electrically insulating carrier varied. As the proportion of the electrically insulating carrier increases, values at shoulders and peaks of DSC drop. A temperature at which such a change emerges (shoulder temperature) can be regarded as a temperature at which the salvation starts.

(Evaluation of the quality of image)

An image was formed according to the aforedescribed image forming method of the present invention wherein a procedure schematically shown in FIG. 2 was adopted.

A developer of Example 1 or Comparative Example 1 is heated to 60° C. in a tank 18 by means of a heater 24 so that a liquefied electrically insulating carrier 20 contains toner particles 22 dispersed therein. When the liquefied developer comes into contact with an electrostatic latent image 16 which has been formed on a photosensitive body 10 by means of a charger 12, toner particles 22 are attracted to the charged region of the photosensitive body 10 to form a developed toner image 30.

The developed toner image 30 passes through an image stabilization roll 32 so that an excessive carrier 20 is squeezed out and becomes a pre-transfer image 34, which is transferred to a roll of paper (transfer paper) 38 and passes through a fixing roll 42 to become a finished image. Besides, in the developing treatment, if the developer solidifies immediately after contacting with the photosensitive body 10, the quality of image may be degraded. Therefore, the photosensitive body 10 itself or its supporting stage may be fitted with a heating means.

In accordance with the above-described procedure, an image was formed by use of a developer of Example 1 or Comparative Example 1 which had a heating temperature (T) set to 60° C., and the obtained images were evaluated. In this case, the melting point (Tm) of the carrier of Example 1 was 36.8° C. and the temperature at which the salvation started (Ts) was 70° C. Meanwhile, the melting point (Tm) of the carrier of Comparative Example 1 was about 50° C. and no salvation was observed.

The image obtained by use of the developer of Example 1 was excellent and had a high resolution. The developer was left to stand for 20,000 hours and then used to develop consecutive 200 copies. No change was observed between the initial image and the image after consecutive 200 copies had been taken, with all images exhibiting a satisfactory quality level. When the temperature of a fixing roll was set to 80° C., the obtained image was entirely free of odor of organic solvent and had a sufficient image fixing strength.

The image obtained by use of the developer of Comparative Example 1 immediately after preparation was acceptable. However, the image obtained by use of the developer of Comparative Example 1 on 10,000 hours' standing after preparation was inferior because of insufficient density of image. The developer was used to develop consecutive 200 copies. The quality of image became progressively worse and was unacceptable. When the temperature of a fixing roll was set to 80° C., the obtained image exhibited a weak image fixing strength. The image was easily removed by rubbing with a rubber eraser and no improvement in the image fixing strength was observed, even if the temperature of the fixing roll was set to a higher temperature.

What is claimed is:

1. A developer for electrostatic photography, comprising toner particles containing a thermoplastic resin and a colorant which tone particles are dispersed in an electrically insulating carrier, wherein the thermoplastic resin is insoluble in the electrically insulating carrier at a temperature below the melting point of the electrically insulating carrier but becomes solvated with the electrically insulating carrier at a temperature above the melting point of the electrically insulating carrier.

2. The developer for electrostatic photography of claim 1, wherein the volume average particle diameter of the toner particles is in the range of 0.5 to 10 μm.

3. The developer for electrostatic photography of claim 1 wherein the toner particles contain an electrostatic charge controller.

4. The developer for electrostatic photography of claim 1 wherein the toner particles contain 1–200 parts by weight of the colorant based on 100 parts by weight of the thermoplastic resin.

5. The developer for electrostatic photography of claim 1 wherein the temperature at which the solvation of the thermoplastic resin of the toner particles with the electrically insulating carrier starts is in the range of 40° to 100° C.

6. The developer for electrostatic photography of claim 1 wherein the thermoplastic resin is an ethylenic polymer.

7. The developer for electrostatic photography of claim 6 wherein the ethylenic polymer is selected from the group consisting of a copolymer of ethylene with an α,β-unsaturated carboxylic acid or with an ester of an α,β-unsaturated carboxylic acid and a copolymer of ethylene with a vinyl acetate.

8. The developer for electrostatic photography of claim 1 wherein the melting point of the electrically insulating carrier is in the range of 20° to 80° C.

9. The developer for electrostatic photography of claim 1 wherein the electrically insulating carrier is selected from paraffins whose principal component is an alkane.

10. The developer for electrostatic photography of claim 8 wherein the paraffins whose principal component is an alkane is selected from normal paraffins which have about 18–40 carbon atoms and which range from octadecane ($C_{18}H_{38}$, melting point 28.2° C.) to hexacontane ($C_{40}H_{82}$, melting point 81.5° C.).

11. The developer for electrostatic photography of claim 1 wherein the electrically insulating carrier contains a charge director.

12. The developer for electrostatic photography of claim 1 wherein the toner particles are comprised in an amount of 0.1–15 weight percent per 100 weight percent of the developer.

* * * * *